US005379690A

United States Patent [19]

Manduley

[11] Patent Number: 5,379,690

[45] Date of Patent: Jan. 10, 1995

[54] SINGLE VALUE POSTAGE DISPENSING APPARATUS

[76] Inventor: Flavio M. Manduley, 87 Old Grassy Hill Rd., Woodbury, Conn. 06798

[21] Appl. No.: 218,046

[22] Filed: Mar. 8, 1994

Related U.S. Application Data

[63] Continuation of Ser. No. 997,044, Dec. 28, 1992, abandoned.

[51] Int. Cl.[6] ..... B41L 47/46

[52] U.S. Cl. ..... 101/91; 235/101

[58] Field of Search ..... 101/91, 110, 72, 78; 235/101; 364/464.02, 464.03

[56] References Cited

U.S. PATENT DOCUMENTS

| | | | |
|---|---|---|---|
| 710,997 | 10/1902 | Pitney . | |
| 3,892,355 | 7/1975 | Malavazos et al. | 235/101 |
| 4,099,049 | 7/1978 | Lowe | 235/101 |
| 4,246,643 | 1/1981 | Hubbard | 101/91 |
| 4,559,443 | 12/1985 | Eckert et al. | 235/101 |
| 4,579,054 | 4/1986 | Buan et al. | 101/91 |
| 4,601,240 | 7/1986 | Sette | 101/91 |
| 4,763,575 | 8/1988 | Miciukiewicz | 101/91 |
| 4,875,788 | 10/1989 | Gasiunas et al. | 101/91 |
| 4,876,956 | 10/1989 | Riley et al. | 101/91 |

FOREIGN PATENT DOCUMENTS

| | | | |
|---|---|---|---|
| 0014649 | 7/1926 | Netherlands | 101/91 |

*Primary Examiner*—Eugene H. Eickholt

*Attorney, Agent, or Firm*—Ronald Reichman; Melvin J. Scolnick

[57] ABSTRACT

The invention is concerned with a low cost postage value generating apparatus of simple construct wherein the number of postage imprints are determined rather than an accounting of the postage dispensed. The apparatus is a single value postage generating device and as such is able to print only one value. Because of this, the number of imprints gives a representation of the total postage value dispensed.

4 Claims, 2 Drawing Sheets

SINGLE VALUE POSTAGE DISPENSING APPARATUS

This application is a continuation of application Ser. No. 07/997,044, filed Dec. 28, 1992 now abandoned.

FIELD OF THE INVENTION

The instant invention resides in the field of value dispensing. There are many ways in which value can be applied to an item as for example imprinted postage indicia, food stamps, theatre tickets, tax stamps the like. The instant invention will be described as it can be practiced in ther field of postage indicia applying. At least with regard to business mail, throughout the years, the most common form of postage has been postage indicia wherein a device such as a postage meter is used to print a postage indicia upon the item to be mailed or upon a tape that is attached to the item to be mailed. This invention is concerned with apparatus for printing postage indicia.

DESCRIPTION OF RELATED ART

By far the most well known device for dispensing postage is the postage meter. Heretofore, postage meters have not been used to any great extent in a home or home office environment because of the cost associated with owning or leasing such a device. It will be appreciated that in the United States postage meters can only be leased from their manufacturer, but in most other countries postage meters can be purchased. These postage value dispensing devices are expensive because of the requirement of precise accounting, and the security associated with such devices. A postage meter has an ascending register which records the value of postage that has been dispensed and a descending register that records the amount of remaining postage purchased by the user of the meter which has been paid to the postal service. Because the postage meter contains the equivalent of monetary value, security measures must be taken to assure that only that amount of postage can be printed for which the mailer has paid and the mailer is able to dispense the postage value he has purchased. Although these devices have worked well in the past, heretofore no commercially successful postage value dispensing device has been provided whereby such an apparatus can be obtained at a low cost. In particular, no one yet has provided a low cost postage value dispensing apparatus which can be discarded of after the postage value has been consumed.

Another feature of prior postage dispensing apparatus is a requirement that values of different amounts can be printed by setting the print head of the postage meter in accordance with the mail to be posted. Because of the requirement that variable amounts of postage be printed, this has added to the complexity of the postage dispensing devices. There are circumstances wherein only a single value need be dispensed, as for example, first class one ounce mail. Despite this fact, no postage dispensing apparatus has been provided that will allow the sending of one ounce, first class mail from the home or home office.

SUMMARY OF THE INVENTION

A postage value dispensing apparatus has been conceived wherein the apparatus is capable of printing only one value, as for example, postage for first class, one ounce mail, letter mail. This is by far the most common mail sent from the home or home office. The apparatus of the instant invention records the number of postage imprints rather than having a direct accounting of the postage value printed. This is possible since the meter postage dispensing apparatus of this invention is capable of printing only single value. Because the apparatus is able to print only one value, the number of imprints gives an accurate representation of the total postage value that has been dispensed.

After the postage value purchased from the postal service has been dispensed, the postage value dispensing apparatus is rendered inoperable in any one of a number of convenient ways.

Since only one postage value is printed and there is no direct accounting of the postage dispensed, a relatively simple and inexpensive apparatus results. More specifically, there is no accounting of the amount of postage disposed, but rather the number of times postage has been dispensed.

DETAILED DESCRIPTION OF THE PREFERRED EMBODIMENT

Figure 1:
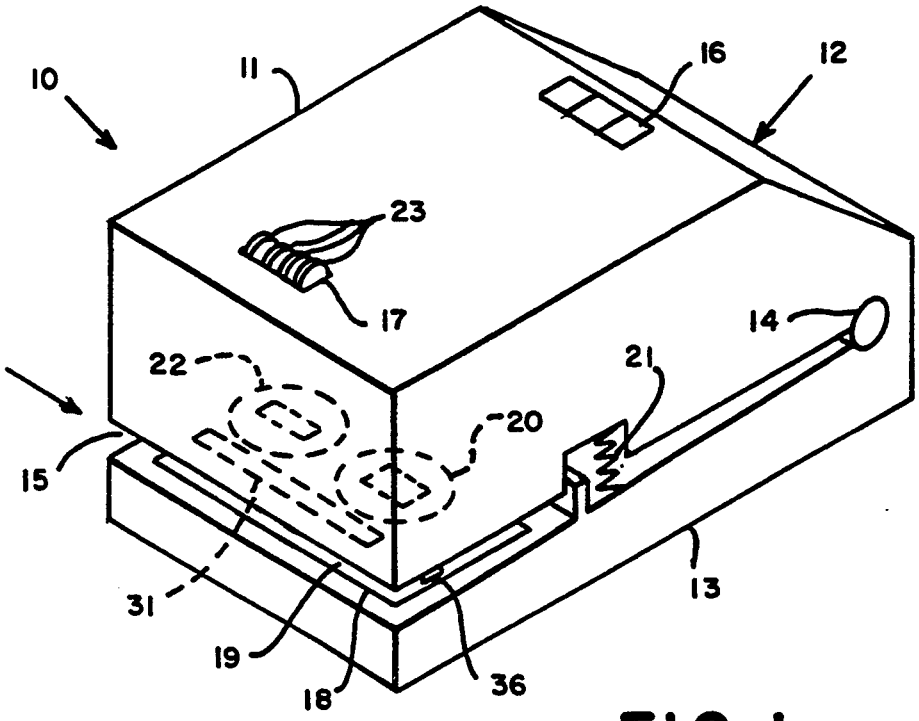
FIG. 1 is a perspective view of the exterior of a postage value dispensing apparatus in which the instant invention can be utilized with some of the interlal components shown.

With reference to FIG. 1, a prospective view is shown of a postage value dispensing apparatus 10 that utilizes the instant invention. The apparatus 10 is provided with a housing 12 that can be a secure housing made preferably of plastic as is well known in the art. See for example U.S. Pat. No. 4,579,054 for a type of housing that can be used in the instant invention. The housing includes an upper portion 11 and a lower portion 13 that are pivotally connected by a pivot shaft 14 to form a slot 15. The upper portion 11 of the housing 12 has an opening 17 and the lower portion 13 of the housing has an opening 18 therein through which a platen 19 is received. Disposed between the upper 11 and lower 13 portions of the housing are a pair of springs 21 (only one being shown) that maintain these portions in spaced relationship. Supported within the housing 12 is an inked postage printhead 20 that is stationary and made of a material such as foam rubber. Such inked rubber printers are well known, as for example Echo hand stamps, available from Schwerdtle Stamp Co., Bridgeport, Conn. A dater.print.head 22 is also received within the housing 12 and has adjustable wheels 23 that are received within the opening 17 by which the dates of the printhead can be changed. Such dating stamps are well known in the art, and will not be described in any great detail. Suffice it to say the date stamper will have a month band 24, two day bands 26 and a year band 28 with each band connected to an appropriate adjustment wheel. The postage printhead 20 will have a single value thereon, as for example, the value of a first class one ounce mail piece, which is presently 29¢. A serial number print head 31 is also provided. The printing of the serial number is provided for purposes of security. As is known, mail with postage indicia printed thereon must be sent to a post office to which the postage dispensing device is assigned. By having each such device channelled through such a single post office, misuse of such a device is reduced. Although a fixed print head 20 for dispensing value is shown, it will be appreciated that a multi-font self inked printing device can be used so that the amount of postage to be printed can be adjusted. Such adjustment would be undertaken either by the post office or by the value dispensing apparatus 10 manufacturer and not by the user of the apparatus. Only those fonts representing the value to be printed would be exposed in the slot 15 with the other fonts containing within the housing 12. Self ink printing devices of this type are commercially available, such as the Echo model Custom D-2 available from Schwerdtly Stamp Co., supra.

Figure 2:
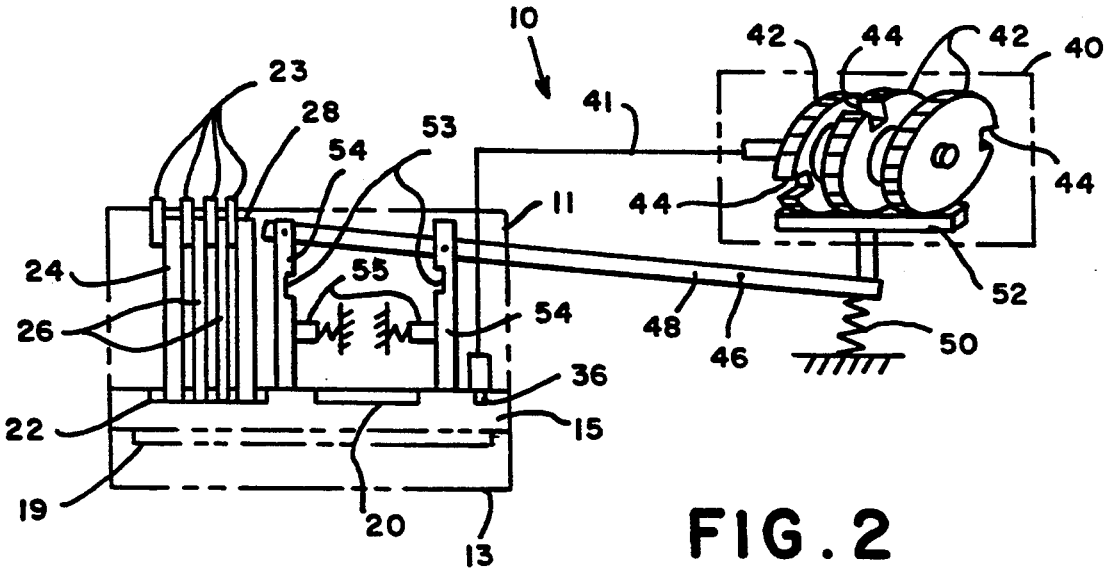
FIG. 2 is a partially cross-sectional view and partially schematic view of a mechanical embodiment of the invention.
Figure 4:
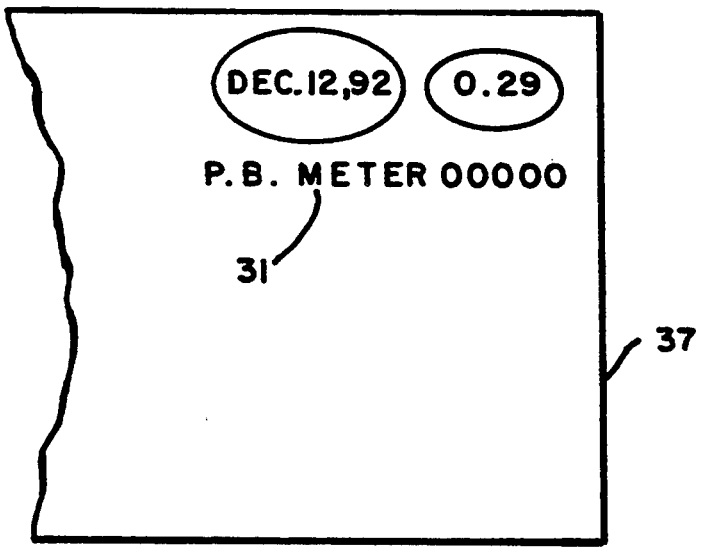
FIG. 4 is a plan view of a mail piece on which indicia has been printed using the instant invention.

With reference now to FIGS. 2 and 4, details will be given of a mechanical type of value dispensing apparatus in which the invention can be practiced. The platen 19 addresses the postage printhead 20, the date printhead 22 and the meter number print head 31. A mail piece 37 can be inserted into the slot 15 as indicated by the single arrow. Located within the slot 15, is an actuator 36 that is actuated upon the platen 19 engaging the printheads 20, 22, 31. This is accomplished by pressing down on the upper portion 11 of the housing to overcome the springs 21 and bring the print heads 20, 22, 31 into printing contact with a mail piece 37 located in the slot 15.

The actuator 36 is in communication with a descending register 40 through a mechanical coupling 41, shown schematically. The descending register 40 has accounting wheels 42 that are viewable from the window 16, so that the user of the apparatus 10 is able to determine the value remaining in the descending register. This descending register is set at the post office at the time payment is made by the apparatus user. Each accounting wheel 42 has the numbers 0–9 on the perimeter thereof so that with three value wheels one is able to dispense postage for up to 999 mail pieces. Of course, the number can be less dependent upon the amount of postage paid by the mailer.

The accounting wheels 42 of the descending register 40 have slots 44 therein that will be in alignment when the user has used the value purchased and zero amount appears in the window 16. A pivot 46 is located in the housing 12 and has a pivot arm 48 pivotally supported thereon. A spring 50 urges the pivot arm 48 in a counter clockwise direction relative to the pivot 46. The end of the pivot arm 48 adjacent the descending register 40 has a latch 52 thereon that is adapted to be received within the slots 44 of the accounting wheels 42 when the value wheels register a zero value. It will be appreciated that the latch 52 must engage all slots 44 simultaneously before the spring 50 can pivot the pivot arm 48. On the opposite end of the pivot arm 48 is a pair of fingers 54 that will be moved into the slot 15 upon the pivot arm 48 rotating about the pivot 46 when the descending register 40 reaches a zero value. Each finger 54 has a recess 53 therein that is adapted to receive a spring loaded latch 55 to secure the fingers after they have been driven into the slot 15 by the arm 48. In this way no further imprint can be obtained from the device.

Figure 3:
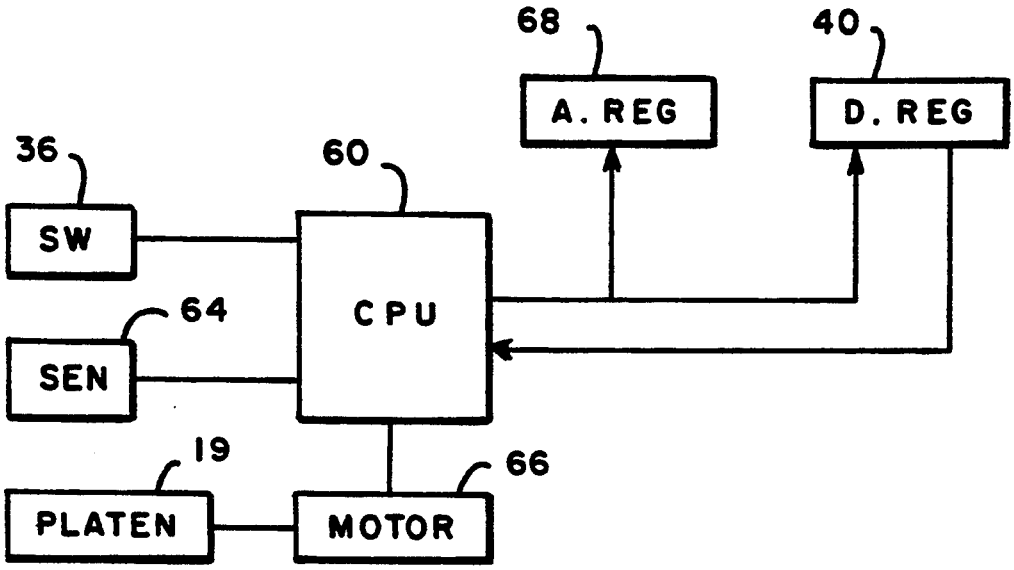
FIG. 3 is a functional block diagram of an electronic embodiment of the instant invention where like reference numbers are used to describe like parts.

With reference now to FIG. 3, a single value postage dispensing apparatus 10 is shown in electronic form. The housing supports a central processing unit (CPU) 60 that communicates with the actuator 36 and a sensor 64 that are located within the slot 15. A motor 66 is in communication with the CPU 60 and the platen 19, which in this case would be a movable platen, whereby upon the sensor sensing the presence of an envelope 37 in the slot 15, the motor 66 will be actuated to drive the platen 19 into engagement with the printheads 20, 22, 31. Upon the platen 19 being driven into engagement with the printheads 20, 22, the CPU will cause the descending register 40 to decrement one unit. When the descending register reaches a zero value, the CPU will disable the entire electronic mechanism of the meter so that no further printing can take place. The CPU can be in communication with the finger 54 to cause it to drop into the slot 15, or it could release a fluid substance so that the self inking printhead 20 would be unable to print anything any further. The electronic embodiment is shown including an ascending register 68 as well as the descending register 40, both of which are in communication with the CPU 60.

An important feature of the invention is that the descending register 40 only increments one unit at a time, each unit representing an event of printing. Each unit represents a first class impression having been printed for a one ounce mail piece 37. Thus the descending register 40 could be adjusted to allow 200 imprints and the user would be required to pay $58.00 for the printing of two hundred 29¢ impressions. Because only numbered events are recorded, a rather low cost counting device can be provided. Also, since there is only one value being printed, there is no need for adjustment of print wheels for different values and there is no need for providing correlation between the printwheels and the descending register to properly record the amount of postage being printed. It will be appreciated that only a descending register has been shown in FIGS. 1 & 2 as that is only what is required for this apparatus, but an ascending register can also be provided as shown in FIG. 3.

Thus what has been shown and described is a low cost "throw away" postage value device that is able to print and account for single value postage.

The above embodiments have been given by way of illustration only, and other embodiments of the instant invention will be apparent to those skilled in the art from consideration of the detailed description. Accordingly, limitations on the instant invention are to be found only in the claims.

What is claimed is:

1. A value dispensing apparatus comprising:

a) a housing;

b) a printhead having a single fixed value font supported in said housing;

c) a counter supported within said housing, wherein said counter includes a plurality of accounting wheels each having a slot therein;

d) a platen spaced from and movable relative to said printhead for contact therewith, said printhead and platen defining a slot therebetween;

e) an actuator spaced relative to said platen within said housing and in communication with said counter for actuating said counter with each contact between said printhead and said platen;

f) means for preventing contact between said print head and said platen upon said counter reaching a zero value;

g) contact preventing means including a pivot supported by said housing and a pivot arm pivotally supported by said pivot;

h) a latch supported at one end of said pivot arm and in engagement with said accounting wheels;

i) at lease one finger located at the other end of said pivot arm at the location of said slot:

j) biasing means for urging said latch toward said accounting wheels and at least one finger toward said housing slot; and k) whereby, upon said latch contacting the accounting wheel slots simultaneously, said biasing means urges said latch into said accounting wheel slots and urges said accounting wheels at least one finger into said housing slot.

2. The apparatus of claim 1 said housing has a date stamp spaced relative to said platen to be contacted thereby upon said platen contacting said printhead.

3. Dispensing apparatus comprising:

a housing having an upper portion and a lower portion pivotally attached, said upper portion and said lower portion defining a housing slot;

a spring urging said upper and lower portions away from one another;

a printhead having a single fixed value font supported in said housing and extending into said housing slot;

a counter supported within said housing, wherein said counter includes a plurality of accounting wheels each having a slot therein;

a platen located on said lower portion at the location of said slot and spaced from said printhead for contact therewith;

an actuator supported by said housing within said slot and in communication with said counter for indicating the number of contacts between said printhead and said platen;

means for preventing contact between said print head and said platen upon said counter reaching a zero value;

contact preventing means including a pivot supported by said housing and a pivot arm pivotally supported by said pivot;

a latch supported at one end of said pivot arm and in engagement with said accounting wheels;

at lease one finger located at the other end of said pivot arm at the location of said slot;

biasing means for urging said latch toward said accounting wheels and at least one finger toward said housing slot; and whereby, upon said latch contacting the accounting wheel slots simultaneously, said biasing means urges said latch into said accounting wheel slots and urges said accounting wheels at least one finger into said housing slot.

4. The apparatus of claim 3 further including a date stamp located within said slot and engageable with said platen.

* * * * *